United States Patent [19]

Fischer

[11] Patent Number: 4,802,663

[45] Date of Patent: Feb. 7, 1989

[54] SHEET SMOOTHER FOR THE GRIPPED EDGE OF THE SHEET IN A SHEET-FED ROTARY PRINTING MACHINE

[75] Inventor: Hermann Fischer, Augsburg, Fed. Rep. of Germany

[73] Assignee: MAN-Roland Druckmaschinen Aktiengesellschaft, Augsburg, Fed. Rep. of Germany

[21] Appl. No.: 873,414

[22] Filed: Jun. 12, 1986

[30] Foreign Application Priority Data

Jun. 15, 1985 [DE] Fed. Rep. of Germany ..... 3521590

[51] Int. Cl.[4] ..... B65H 9/18

[52] U.S. Cl. ..... 271/227; 271/246

[58] Field of Search ..... 271/227, 228, 229, 230, 271/245, 247, 277, 82, 165, 246

[56] References Cited

U.S. PATENT DOCUMENTS

| | | | |
|---|---|---|---|
| 1,984,588 | 12/1934 | Liebusch | 271/247 |
| 2,899,202 | 8/1959 | Mestre | 271/247 |
| 3,884,461 | 5/1975 | Hauser | 271/277 |
| 4,645,195 | 2/1987 | Scranton | 271/245 |

*Primary Examiner*—Richard A. Schacher

*Attorney, Agent, or Firm*—Frishauf, Holtz, Goodman & Woodward

[57] ABSTRACT

For smoothing of the leading edges of sheets disposed on the feed table of a sheetfeeder for a rotary printing machine, a vertically reciprocable rule (3) is provided. Prior to grasping of each sheet by grippers (16), the rule is lowered onto the sheets on the table (1), thereby ironing out waviness, so that the sheets may be evenly and securely grasped by the grippers (16) and correctly fed into the printing machine. In order to position the rule as close as possible to the leading edge of the sheets, the rule has recesses (5, 6) which accomodate the grippers (16) and front gauges (17).

8 Claims, 2 Drawing Sheets

SHEET SMOOTHER FOR THE GRIPPED EDGE OF THE SHEET IN A SHEET-FED ROTARY PRINTING MACHINE

The present invention relates generally to smoothing devices for sheet-fed, rotary printing presses, and more particularly to a smoother having a vertically reciprocable beam or rule which presses on the leading edge of the stack of sheets, prior to grasping of each sheet by grippers.

BACKGROUND

The quality of printing on single sheets is often unsatisfactory. One reason, among others, for this resides in the sheetfeeding apparatus. If the sheet doesn't lie in fully extended position on the feeder, i.e. on the front gauges, it is grasped in a wavy or warped condition and fed that way to the first printing unit. Between the printing cylinders, the sheet is pulled or gathered, stretched, and perhaps also accordioned lengthwise. This can lead to ghosting. If, for example, a first sheet lies flat on the feeder, while the next sheet lies warped or wrinkled, this leads inevitably to differing sheet positions in the particular printing units. If one sheet to be printed has passed through the first printing unit and is fed to the second printing unit, it has more or less undergone a relaxation process, i.e. the first color is transferred in the second printing unit to a different position, which causes a loss of print quality.

There are a number of devices generally known which seek to achieve a flat orientation of the sheets and their leading edges upon feeding into the sheetfeeder, and to avoid or eliminate waviness or warping. German Pat. No. 27 13 994, Fischer, assigned to a related company of the assignee of this application, discloses a paper stretching apparatus which pulls the leading corners, of a sheet grasped by the grippers, away from each other sidewise. Such paper stretching devices are, indeed, relatively effective in correcting the aforementioned problem, but, due to the extensive mechanical effort required, they are relatively expensive.

THE INVENTION

It is an object of the present invention to provide a sheet stretching device for the feed table of a sheetfeeder which is simply constructed, and with which it is possible to smooth out the waviness in the sheets' leading edges, the so-called "gripped edges", before they are grasped by the grippers, and to more easily separate the sheet first fed into the machine or into the first printing unit from the underlying sheets which are to be fed subsequently.

Briefly, the present invention achieves this by reciprocating a rule onto the leading edges of the sheets as they arrive at a feed table before each sheet is grasped by the grippers, and raising it out of the way as the sheet is fed into the printing machine.

DRAWINGS

DETAILED DESCRIPTION

Figure 1:
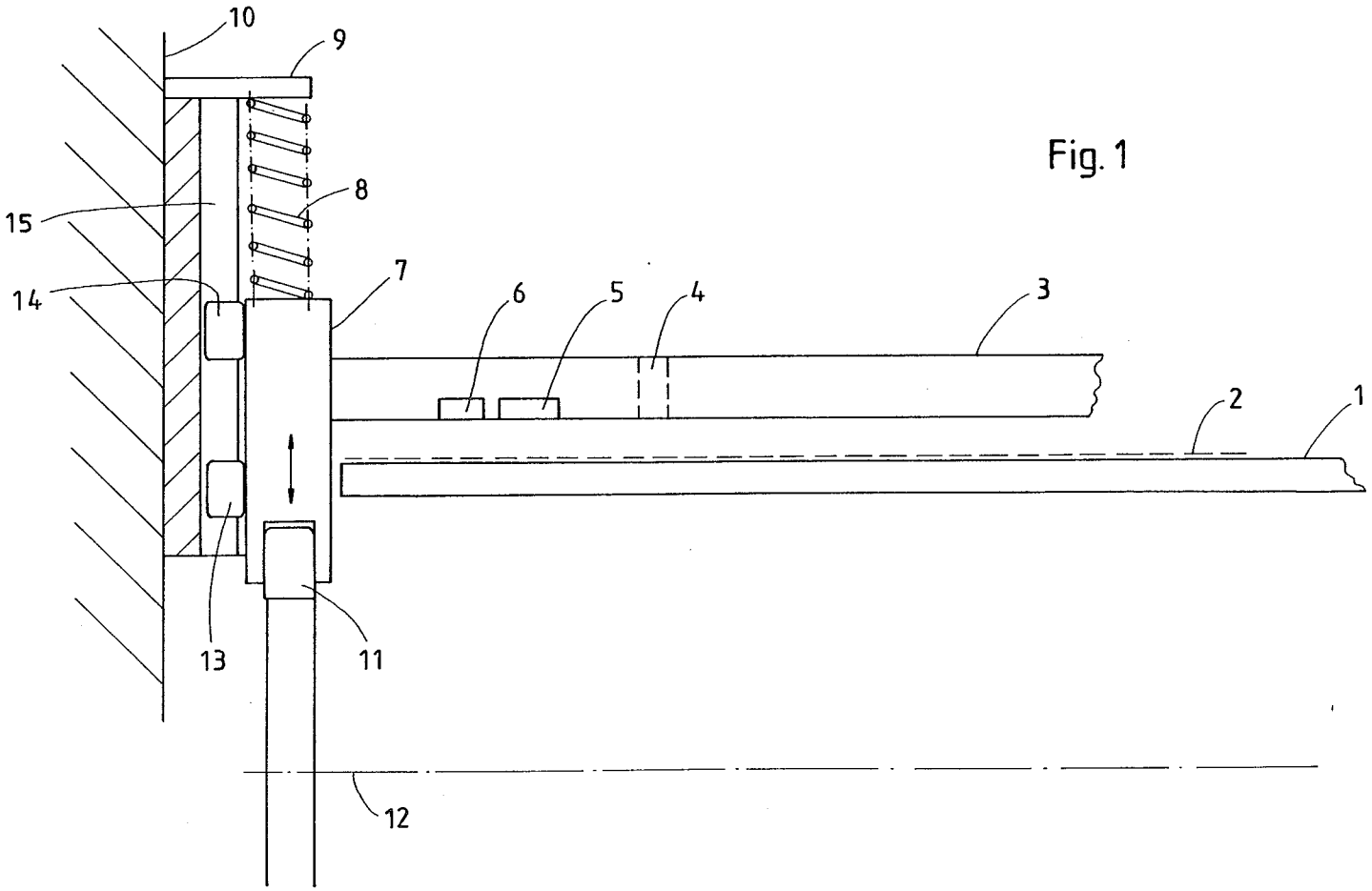
FIG. 1 is a front view of a sheetfeeder with the sheet smoother of the present invention.

The sheet smoother of the present invention may be installed in sheetfeeders of conventional construction, which are well known and need not be described in detail. FIG. 1 shows a feed table 1, onto which a sheet 2 to be fed into the printing machine is placed. In accordance with the invention, a vertically reciprocable rule or beam 3 is disposed, perpendicular to the feed direction, above the feed table 1 and above the sheet 2 fed onto the table. This rule 3 produces the smoothing action. Preferably, rule 3 is formed with vertical openings 4 for placement of photodiodes (not shown) which are often used for sheet monitoring. In addition, recesses 5 and 6 are provided in rule 3. On at least one side, rule 3 is fastened to a vertically reciprocable lifter 7.

Lifter 7 is pressed toward the feed table 1 and sheet 2 by a spring 8, whose upper end rests against a counterplate 9 which is connected to the sidewall 10 of the machine. Lifter 7 is driven up, against the pressure of spring 8, by a cam and a control roller 11. For this control, a so-called single-revolution shaft 12, indicated schematically in FIG. 1, can be used.

In order to obtain corresponding reciprocation of lifter 7 and rule 3, guide rollers 13, 14 are arranged on the lifter 7 and run up and down in a corresponding groove (not shown) of a track 15 fastened to the sidewall 10 of the machine.

Figure 2:
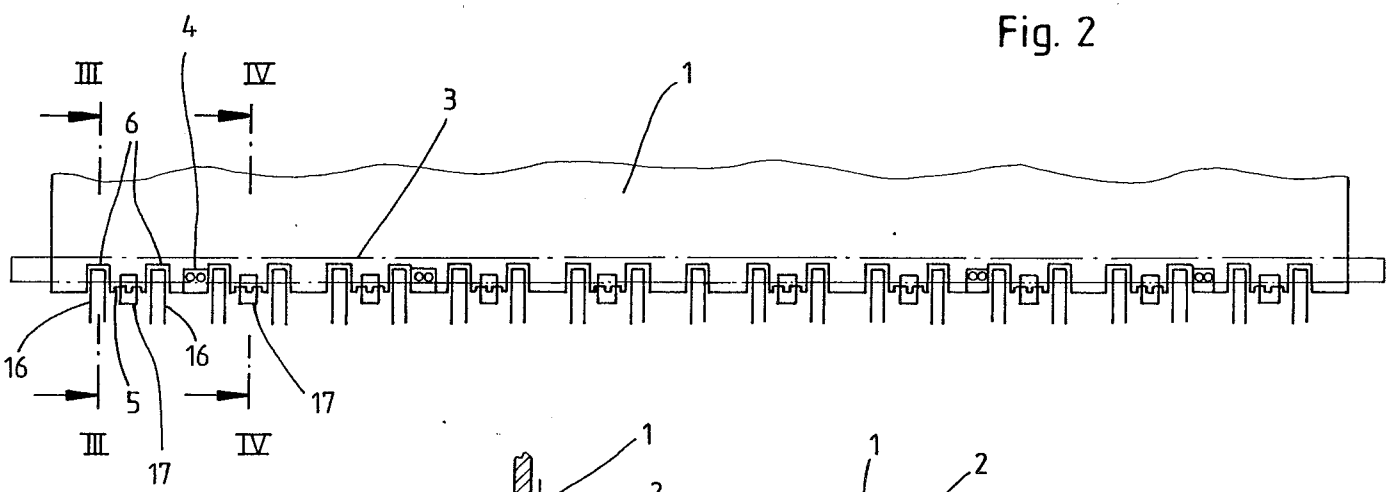
FIG. 2 is a top view of the sheetfeeder of FIG. 1, toward the feed table.

As shown in FIGS. 1 and 2, recesses 5 and 6 are formed at respective positions in rule 3, and receive respectively grippers, preferably pre-grippers 16 for grasping the sheet and feeding it into the first printing unit, and front gauges 17. This makes it possible to position rule 3 as closely as possible to the leading sheet edge over the feed table 1, thereby increasing its effectiveness.

Figure 3:
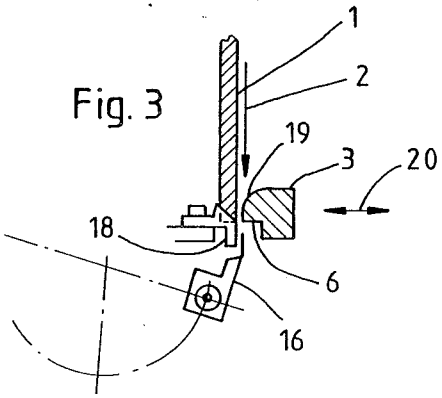
FIG. 3 is a sectional view along line III—III of FIG. 2.
Figure 4:
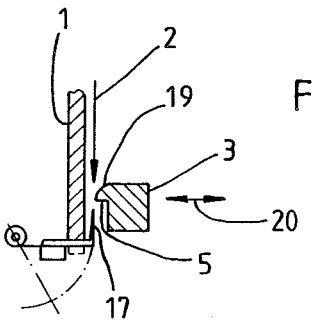
FIG. 4 is a sectional view along line IV—IV of FIG. 2.

As shown in FIGS. 3 and 4, rule 3 is preferably formed with rounded corners 19 in the sheet entrance region, which facilitates the entrance or feeding in of the sheets. As indicated by arrow 20, for smoothing of the leading edge of the sheet 2 resting on the front gauges 17, rule 3 is driven by sinking of the lifter 7 as tightly as possible onto the feed table 1 and the sheet 2 thereon. Waves or ripples are thereby forced out of the to-be-gripped edges or leading portion of the sheet 2, so that the latter rests flat on the feed table 1. The grippers 16 can thus safely grasp the sheet in this extended condition.

Once the sheet 2 has been grasped, after smoothing, by the grippers 16, and fed off the feed table into the first printing unit of the printing machine, rule 3 is raised upward by corresponding control by lifter 7. Clearly, front gauges 17 were pivoted away in the usual fashion, prior to drawing off of the sheet 2. The raising of rule 3 prior to the feeding of sheet 2 allows the sheet sufficient freedom to easily separate it from the underlying following sheets. This also avoids the danger that the underlying following sheets will be drawn upward over part or all of their breadth. In such a situation, the flat lay, along its leading edge, of a newly arriving sheet would be adversely affected or compromised.

The present invention's arrangement of rule 3 and its control assures that the newly arriving sheet can subsequently be laid down without undesired ripples, creases, or the like. Any remaining deformations which might persist can be easily pressed out by subsequent downward motion of rule 3 under corresponding control of the control roller 11.

One advantage of the invention is that the degree of freedom of height of the sheet is constrained across its entire breadth. Therefore, it is impossible for the sheet to be only partly depressed, as sometimes happened with prior art devices. Rather, the sheet is evenly depressed across its entire breadth and freed of waviness and wrinkles. Further, the sheet smoother of the present invention prevents undesired sidewise movement of the sheet, which could influence or destroy the lateral or sidewise register of the sheet.

With the sheet smoother of the present invention, the gripped edge can be kept flat both before and after alignement and even feeding of sheets into the printing machine is assured. This has the deisred result of improving print quality by reducing ghosting.

Various changes and modifications are possible within the scope of the inventive concept.

I claim:

1. A sheet smoother for a sheet-fed rotary printing machine having a sheet feeder with
   a feed table (1) having a feeding edge and adapted to support a plurality of sheets (2); and
   grippers (16) and front gauges (17) disposed along the feeding edge of said table (1);
   comprising
   a vertically reciprocable beam-shaped rule (3) disposed above said feed table (1), extending perpendicularly to sheet-feeding direction and located adjacent the feeding edge of the sheet when the sheet is positioned against the front gauges (17), said rule being formed along one edge with a plurality of transversely extending recesses (5, 6), located immediately adjacent to, and adapted for receiving, said grippers (16) and front gauges (17);
   a lifter (7) supporting said rule (3); and
   means for raising said lifter (7) and said rule (3) during removal of a sheet (2) by said grippers (16) from said table (1) and for subsequently lowering an axially continuous portion of an undersurface of said rule (3) onto a following sheet, for smoothing the entire width of the leading edge of said following sheet (2) on said table (1).

2. A sheet smoother according to claim 1, wherein
   said rule (3) has a rounded corner (19) adjacent to a sheet entrance region of said machine.

3. A sheet smoother, for a sheet-fed rotary printing machine having a sheet feeder with
   a feed table (1) having a feeding edge and adapted to support a plurality of sheets (2); and
   grippers (16) and front gauges (17) disposed along the feeding edge of said table (1);
   comprising a vertically reciprocable beam-shaped rule (3) disposed above said feed table (1), extending perpendicularly to sheet-feeding direction and located adjacent the feeding edge of the sheet when the sheet is positioned against the front gauges (17);
   a lifter (7) supporting said rule (3); and
   means for raising said lifter (7) and said rule (3) during removal of a sheet (2) by said grippers (16) from said table (1) and for subsequently lowering said rule (3), for smoothing the leading edge of a following sheet (2) on said table (1), and wherein
   said rule (3) is formed with apertures (4) adapted to receive photodiodes for sheet monitoring and with recesses (5,6) corresponding to positions of said grippers (16) and front gauges (17).

4. A sheet smoother according to claim 3, wherein
   said rule (3) has a rounded corner (19) adjacent to a sheet entrance region of said machine.

5. A sheet smoother according to claim 3, wherein
   said recesses (5, 6) are formed on said rule (3) immediately adjacent to said grippers (16) and said front gauges (17).

6. A sheet smoother, for a sheet-fed rotary printing machine having a sheet feeder with
   a feed table (1) having a feeding edge and adapted to support a plurality of sheets (2); and
   grippers (16) and front gauges (17) disposed along the feeding edge of said table (1);
   comprising a vertically reciprocable beam-shaped rule (3) disposed above said feed table (1), extending perpendicularly to sheet-feeding direction and located adjacent the feeding edge of the sheet when the sheet is positioned against the front gauges (17);
   a lifter (7) supporting said rule (3); and
   means for raising said lifter (7) and said rule (3) during removal of a sheet (2) by said grippers (16) from said table (1) and for subsequently lowering said rule (3), for smoothing the leading edge of a following sheet (2) on said table (1), and wherein
   a spring (8) on a stationary mounting (9, 10) is provided and presses said rule (3) toward said feed table (1); and
   a single-revolution shaft (12) and a control roller (11) driven thereby, intermittently lift said rule (3) upward from said feed table (1).

7. A sheet smoother according to claim 6, wherein
   a guide track (15), and a pair of guide rollers (13, 14) riding therein, are provided; and
   said lifter (7) is guided on said rollers perpendicularly to said feed table (1).

8. A sheet smoother according to claim 6, wherein
   said rule (3) has a rounded corner (19) adjacent to a sheet entrance region of said machine.

* * * * *